US005718209A

United States Patent [19]

Scardino et al.

[11] Patent Number: 5,718,209

[45] Date of Patent: Feb. 17, 1998

[54] FUEL VAPOR STORAGE CANISTER

[75] Inventors: Eileen Alanna Scardino, Rochester; Susan Scott Labine, Avon; Robert Augustine Zaso, Rochester; Susan Buckner, Caledonia; Thomas Charles Meiller, Pittsford, all of N.Y.

[73] Assignee: General Motors Corporation, Detroit, Mich.

[21] Appl. No.: 762,374

[22] Filed: Dec. 9, 1996

[51] Int. Cl.[6] ..... F02M 33/02

[52] U.S. Cl. ..... 123/519; 55/385.3

[58] Field of Search ..... 123/516, 518, 123/519, 520; 55/385.3, 478–9

[56] References Cited

U.S. PATENT DOCUMENTS

| | | | |
|---|---|---|---|
| 4,306,894 | 12/1981 | Fukami et al. | 55/316 |
| 4,308,840 | 1/1982 | Hiramatsu et al. | 123/519 |
| 4,331,120 | 5/1982 | Hiramatsu et al. | 123/519 |
| 4,338,106 | 7/1982 | Mizuno et al. | 55/316 |
| 4,381,929 | 5/1983 | Mizuno et al. | 55/316 |
| 4,386,947 | 6/1983 | Mizuno et al. | 55/387 |
| 4,403,587 | 9/1983 | Mizuno et al. | 123/519 |
| 4,430,099 | 2/1984 | Yanagisawa et al. | 55/316 |
| 4,446,838 | 5/1984 | Suzuki et al. | 123/520 |
| 4,454,849 | 6/1984 | Mizuno et al. | 123/519 |
| 4,496,379 | 1/1985 | Kozawa | 55/387 |
| 4,507,132 | 3/1985 | Yoshida | 55/320 |
| 4,598,686 | 7/1986 | Lupoli et al. | 123/519 |
| 4,693,393 | 9/1987 | DeMinco et al. | 220/374 |
| 4,750,465 | 6/1988 | Rediker, Jr. et al. | 123/519 |
| 4,758,255 | 7/1988 | Yamada et al. | 55/316 |
| 4,766,872 | 8/1988 | Kato et al. | 123/519 |
| 4,778,495 | 10/1988 | Bishop et al. | 55/269 |
| 4,853,009 | 8/1989 | Turner et al. | 55/587 |
| 4,951,643 | 8/1990 | Sato et al. | 123/520 |
| 4,962,744 | 10/1990 | Uranishi et al. | 123/520 |
| 5,005,550 | 4/1991 | Bugin, Jr. et al. | 123/520 |
| 5,119,791 | 6/1992 | Gifford et al. | 123/519 |
| 5,170,765 | 12/1992 | Hoshino et al. | 123/520 |
| 5,173,095 | 12/1992 | Yasukawa et al. | 55/316 |
| 5,304,235 | 4/1994 | Watanabe et al. | 96/144 |
| 5,355,861 | 10/1994 | Arai | 123/519 |
| 5,361,743 | 11/1994 | Denz et al. | 123/519 |
| 5,373,830 | 12/1994 | Denz et al. | 123/520 |
| 5,408,976 | 4/1995 | Reddy | 123/519 |
| 5,453,118 | 9/1995 | Heiligman | 96/147 |
| 5,456,236 | 10/1995 | Wakashiro et al. | 123/519 |
| 5,460,136 | 10/1995 | Yamazaki et al. | 123/519 |

*Primary Examiner*—Thomas N. Moulis
*Attorney, Agent, or Firm*—Saul Schwartz

[57] ABSTRACT

A fuel vapor storage canister having a leak-proof screen assembly between a mass of carbon granules in the storage canister and a purge port of the storage canister. The fuel vapor storage canister includes a cup-shaped plastic body, an integral partition which divides the canister body into a pair of relatively deep carbon bed chambers, and a plenum in the canister body at an end of one of the carbon bed chambers which is connected to the purge port and which is covered by the leak-proof screen assembly. The leak-proof screen assembly includes a plastic frame ultrasonically welded to the canister body and a flat fabric screen having a peripheral edge insert molded to the plastic frame.

3 Claims, 3 Drawing Sheets

FUEL VAPOR STORAGE CANISTER

TECHNICAL FIELD

This invention relates to fuel vapor storage canisters in motor vehicle evaporative emission control systems.

BACKGROUND OF THE INVENTION

Typical motor vehicle evaporative emission control systems include a fuel vapor storage canister, a mass of carbon granules in the storage canister, a vapor transfer duct between a vapor inlet port of the storage canister and a fuel tank of the motor vehicle, a canister purge duct between a motor of the vehicle and a purge port of the storage canister, and a solenoid valve in the canister purge duct. When the motor is on, the solenoid valve opens the canister purge duct to induce a flow of air through the mass of carbon granules in the canister to strip fuel vapor therefrom. It is known to equip such prior fuel vapor storage canisters with a plastic foam screen between the mass of carbon granules and the purge port to minimize contamination of the solenoid valve in the canister purge duct by entrained carbon granules. Such foam screens are effective but may permit downstream migration of carbon granules in the circumstance that vibration of the storage canister shakes loose the plastic foam screen.

SUMMARY OF THE INVENTION

This invention is a new and improved fuel vapor storage canister having a leak-proof screen assembly between a mass of carbon granules in the storage canister and a purge port of the storage canister. The fuel vapor storage canister includes a cup-shaped plastic body, an integral partition which divides the canister body into a pair of relatively deep carbon bed chambers, and a plenum in the canister body at an end of one of the carbon bed chambers which is connected to the purge port and which is covered by the leak-proof screen assembly. The leak-proof screen assembly includes a plastic frame hermetically bonded to the canister body and a flat screen having a peripheral edge hermetically bonded to the plastic frame. The hermetic bonds between the plastic frame and the peripheral edge of the flat screen and between the plastic frame and the canister body positively prevent dislodgement of the peripheral edge of the screen from the canister body and migration of carbon granules around the screen. In a preferred embodiment, the plastic frame is molded around the peripheral edge of the screen and ultrasonically welded to the canister body, and the flat screen is a fabric consisting of spun bonded polyester.

DESCRIPTION OF THE PREFERRED EMBODIMENT

Figure 1:
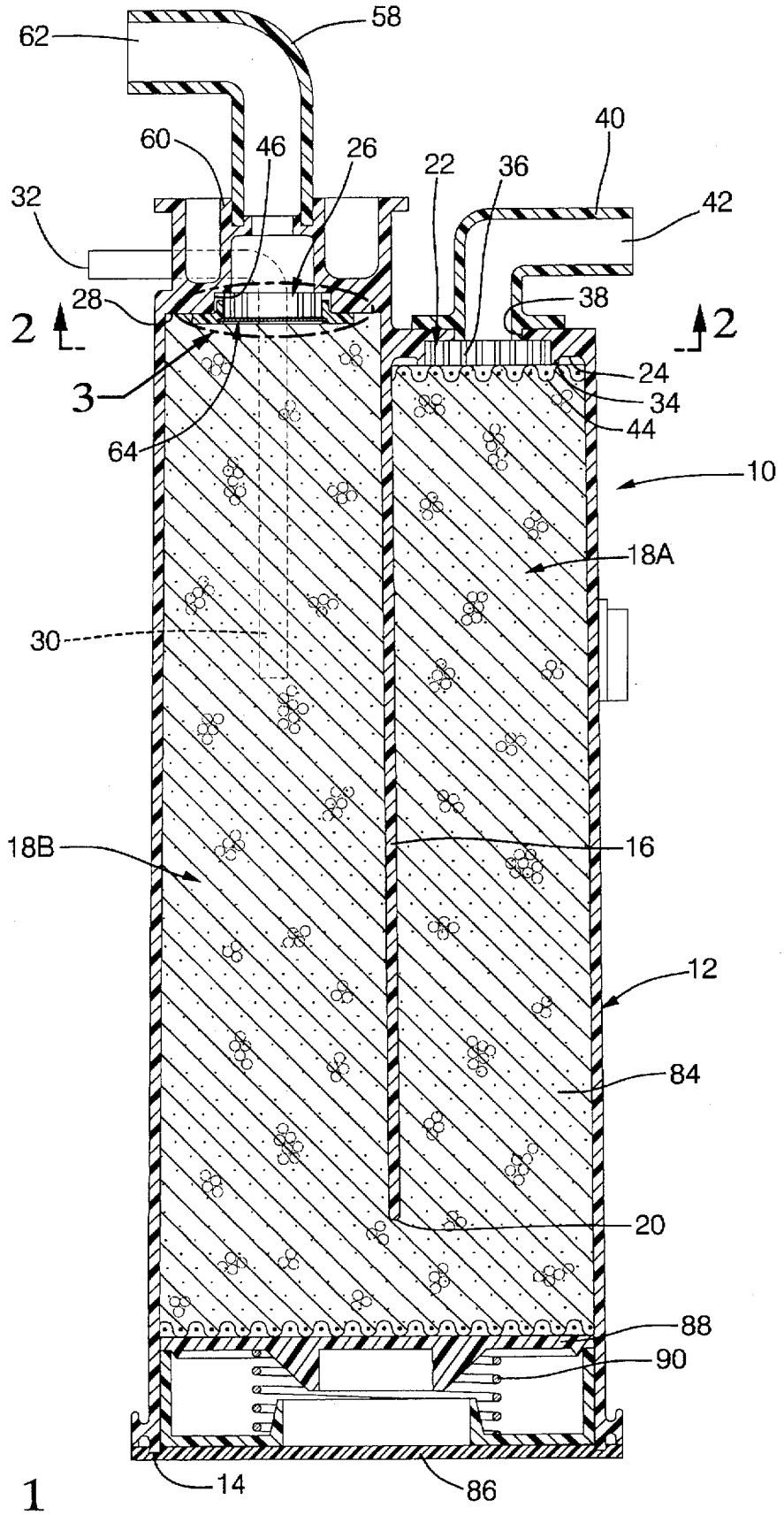
FIG. 1 is a sectional view in elevation of a fuel vapor storage canister according to this invention.
Figure 2:
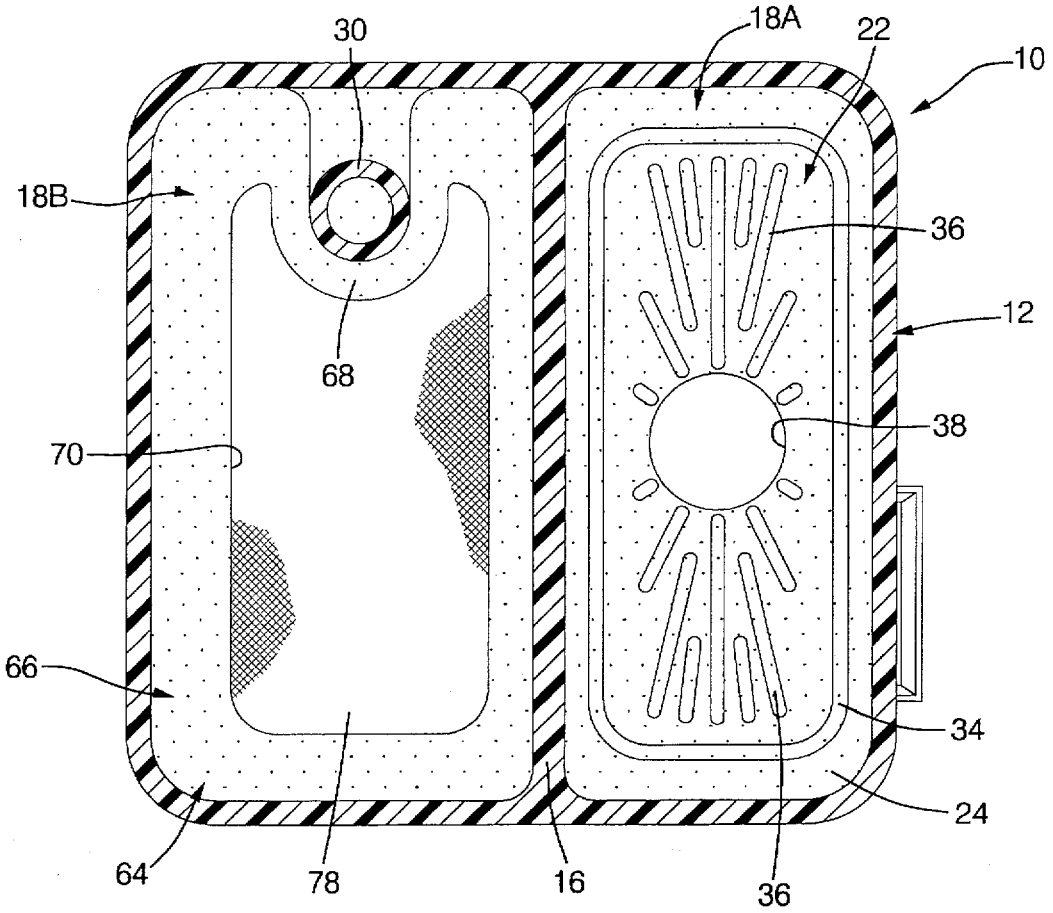
FIG. 2 is a sectional view taken generally along the plane indicated by lines 2—2 in FIG. 1.

Referring to FIGS. 1–4, a fuel vapor storage canister 10 according to this invention includes a cup-shaped canister body 12 made of molded plastic open through an end 14 of the canister body. An integral partition 16 divides the canister body into a pair of long, rectangular carbon bed chambers 18A–18B and terminates at an edge 20 inboard of the end 14 of the canister body. A first plenum 22 of the vapor storage canister 10 is molded into the canister body 12 at an end 24 of the carbon bed chamber 18A. A second plenum 26 of the vapor storage canister 10 is molded into the canister body 12 at an end 28 of the carbon bed chamber 18B. A schematically represented tubular elbow 30 traverses the canister body through the end 28 of the carbon bed chamber 18B into the latter. The end of the tubular elbow 30 outside of the canister body 10 defines a vapor inlet port 32 of the vapor storage canister 10.

The first plenum 22 consists of a raised rectangular boss 34 on the canister body at the end 24 of the carbon bed chamber 18A surrounding a plurality of linear bosses 36 on the canister body of substantially the same height as the rectangular boss 34. The linear bosses radiate from an aperture 38 in the canister body 12 in the middle of the first plenum. A tubular plastic elbow 40 is rigidly connected to the canister body in the aperture 38 and defines a vent port 42 of the storage canister 10 through which the first plenum 22 communicates with the atmosphere surrounding the storage canister. The first plenum 22 is covered by a conventional plastic foam screen 44 which seats on the rectangular boss 34 and on the linear bosses 36.

The second plenum 26 consists of a rectangular cavity 46 in the canister body at the end 28 of the carbon bed chamber 18B surrounded by a plane rectangular land 48 on the canister body. The plane land 48 has a loop 50 around the tubular elbow 30 where the latter traverses the end 28 of the carbon bed chamber 18B. The second plenum 26 has a plurality of integral linear bosses 52 perpendicular to a bottom 54 of the rectangular cavity 46 of the same height as the depth of the cavity 46 and radiating from an aperture 56 in the end 28 of the carbon bed chamber 18B. On the outside of the canister body 12, a third tubular elbow 58 is rigidly attached to a boss 60 around the aperture 56 and defines a purge port 62 of the vapor storage canister 10.

The second plenum 26 is covered by a screen assembly 64 of the storage canister 10. As seen best in FIGS. 2–4, the screen assembly 64 includes a flat, generally rectangular plastic frame 66 having a loop 68 at one end, a window 70 in the frame, a continuous lip 72 around the window perpendicular to the plane of the frame, and a continuous triangular boss 74 outboard of the lip 72 having a sharp edge 76 where the sides of the boss converge. A flat fabric screen 78 of the screen assembly 64 fills the window 70 of the frame 66 and is made of spun bonded polyester fibers and is available from BBA Nonwoven Company under the tradename Reemay. The fabric screen 78 has pores between its fibers which capture particles of on the order of 50 microns and larger entrained in a gaseous flow through the screen.

Figure 3:
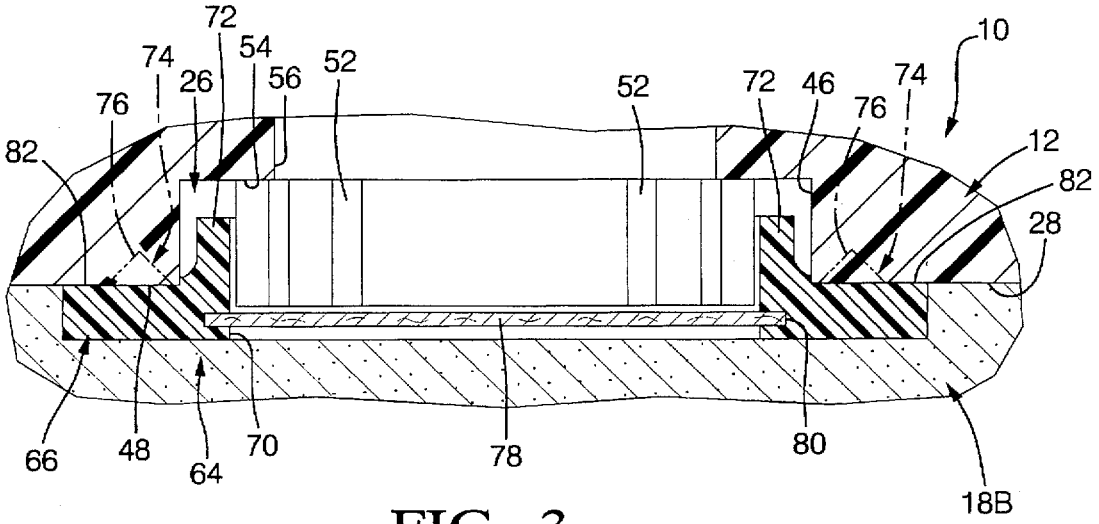
FIG. 3 is an enlarged view of the portion of FIG. 1 in the reference circle 3.
Figure 4:
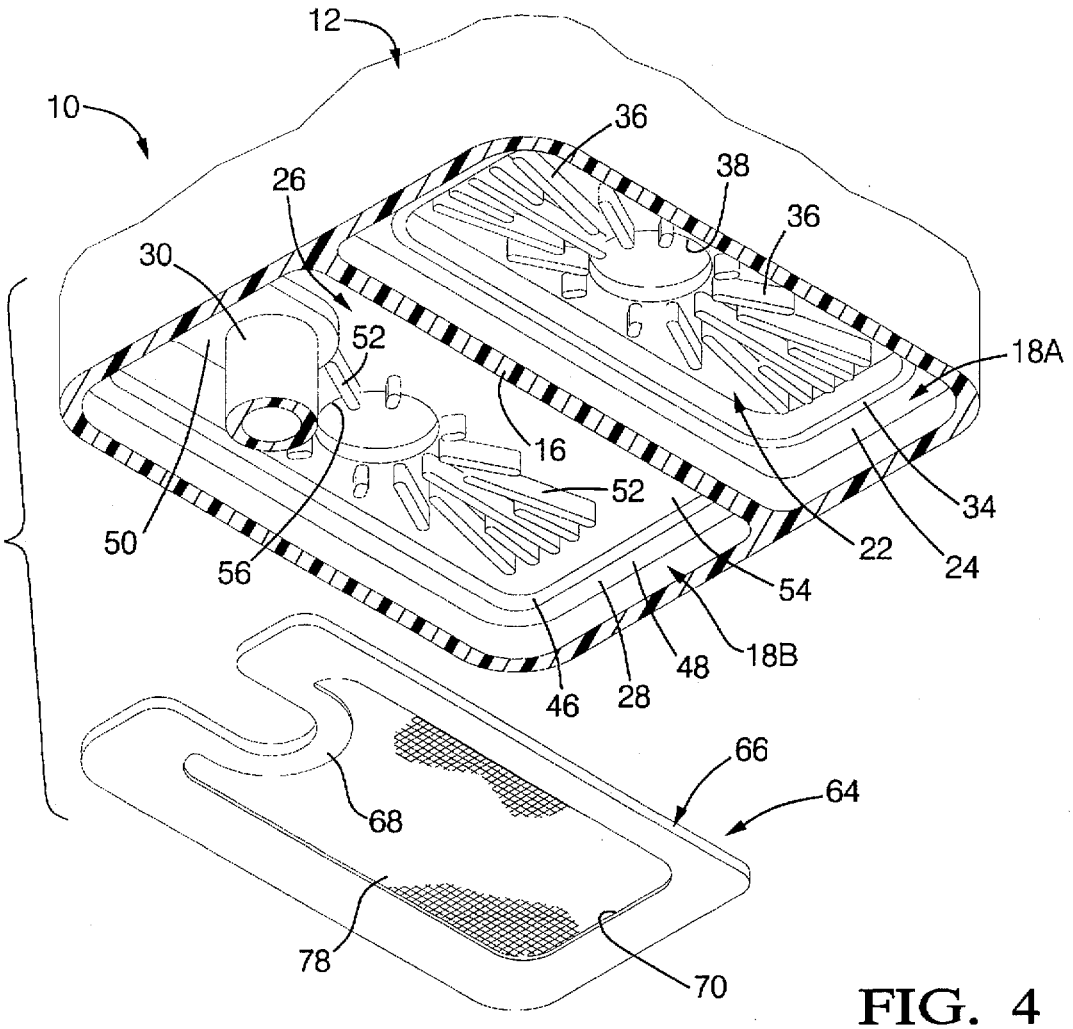
FIG. 4 is a fragmentary, exploded perspective view of the fuel vapor storage canister according to this invention illustrating a screen assembly thereof detached from a canister body thereof.

The plastic frame 66 is molded in an insert molding apparatus, not shown, which permits the frame to be molded around a peripheral edge 80 of the screen 78, FIG. 3. That is, the screen 78 is suspended with its peripheral edge 80 in a cavity of the mold apparatus corresponding to the shape of the frame. Liquid plastic introduced into such cavity completely fills the cavity and envelops the peripheral edge 80 of the screen so that when the liquid plastic cures solid, the peripheral edge 80 is rigidly connected to the plastic frame and hermetically sealed against leakage attributable to the screen being shaken loose from the plastic frame.

The plastic frame 66 and insert molded screen 78 cover the second plenum 26 with the sharp edge 76 of the triangular boss 74 seated against the plane land 48. An ultrasonic welding apparatus, not shown, engages the plastic frame 66 from inside of the carbon bed chamber 18B and presses the plastic frame against the plane land 48 while concurrently vibrating the plastic frame at high frequency. Friction between the plastic frame 66 and the plane land 48 concentrated at the sharp edge 76 of the triangular boss 74 induces sufficient heat to fuse together the plastic frame and the canister body 12 along an interface 82, FIG. 3, outboard of the lip 72 and thereby effect a rigid, hermetically sealed connection between the frame and the canister body. The lip 72 on the plastic frame 66 defines a flash dam between the triangular boss 74 and the window 70 in the plastic frame which prevents contamination of the fabric screen 78 during ultrasonic welding of the plastic frame to the canister body. Ultrasonic welding at the following settings has proved successful: weld energy: 300 joules, weld pressure: 550 kPa, and weld velocity: 33 mm/sec.

After the foam screen 44 and the screen assembly 64 are in place over the first and the second plenums 22, 26, respectively, the canister body 12 is filled through its open end 14 with a mass 84 of carbon granules to above the edge 20 of the partition 16. A cover 86 seals closed the open end 14 of the canister body. An end plate 88 biased against the mass 84 of carbon granules by a spring 90 between the end plate and the cover 86 aggregates the carbon granules in both carbon bed chambers 18A–18B and in the portion of the canister body beyond the edge 20 of the partition 16.

Figure 5:
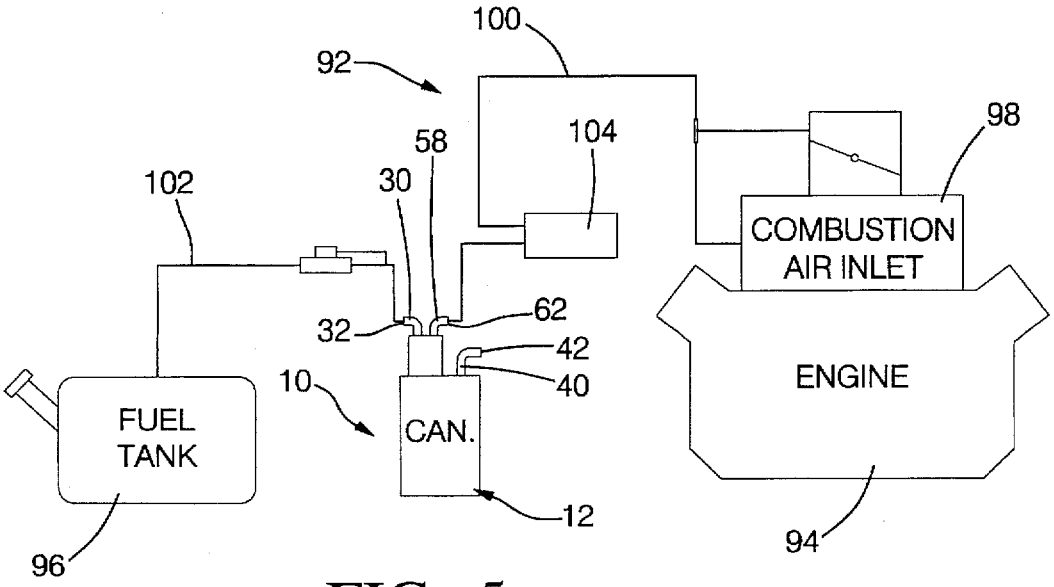
FIG. 5 is a fragmentary, schematic representation of a motor vehicle evaporative emission control system including the fuel vapor storage canister according to this invention.

Referring to FIG. 5, the vapor storage canister 10 is incorporated in a schematically and fragmentarily illustrated evaporative emission control system 92 of a motor vehicle between a motor 94 of the vehicle and a fuel tank 96 of the vehicle. A combustion air inlet 98 of the motor 94 is connected to the purge port 62 of the storage canister 10 through a vapor purge duct 100. The fuel tank 96 of the motor vehicle is connected to the vapor inlet port 32 of the storage canister 10 through a vapor transfer duct 102. A solenoid valve 104 in the purge duct 100 opens and closes the purge duct when the motor 44 is on and off, respectively.

Vapor pressure in the fuel tank 96 induces a flow of a mixture of fuel vapor and air to the carbon bed chamber 18A through the vapor transfer duct 102, the vapor inlet port 32, and the tubular elbow 30. Inside the canister body, the fuel vapor and air mixture circulates through the mass 84 of carbon granules toward the vent port 42 during which circulation the carbon granules strip the vapor from the mixture so that only uncontaminated air is expelled through the vent port. The solenoid valve 104 closes the purge duct 100 when the motor 94 is off to prevent escape of fuel vapor from the canister body through the purge duct.

When the motor is on, subatmospheric pressure prevails in the combustion air inlet 98 of the motor and the solenoid valve 104 opens the purge duct 100. The pressure gradient between the combustion air inlet 98 and the vent port 42 of the storage canister 10 induces a flow of fresh air through the carbon bed chambers 18A–18B from the vent port toward the purge port 62. The fresh air strips fuel vapor from the mass 84 of carbon granules in the canister body to produce a gaseous mixture of air and fuel vapor which flows to the combustion air inlet 98 through the fabric screen 78, the second plenum 26, the vapor purge port 62, and the purge duct 100. The fabric screen 78 traps carbon granules entrained in such gaseous mixture to prevent contamination of the solenoid valve 104 in the purge duct 100 downstream of the purge port 62. Importantly, even in the circumstance that the storage canister 10 experiences substantial vibration, the rigid attachment and hermetic seal between the peripheral edge 80 of the fabric screen 78 and the plastic frame 66 and between the plastic frame 66 and the canister body 12 positively prevents the peripheral edge of the screen from being shaken loose from the canister body.

We claim:

1. A fuel vapor storage canister for a motor vehicle evaporative emission control system including a plastic cup-shaped canister body having a vent port through which said canister body communicates with the atmosphere surrounding said fuel vapor storage canister and a purge port through which said canister body communicates with a region of subatmospheric pressure to induce a flow of air through said canister body from said vent port to said purge port, a mass of carbon granules in said canister body, a plenum in said canister body exposed to said mass of carbon granules therein and connected to said purge port, and a screen assembly between said plenum and said mass of carbon granules in said canister body, characterized in that said screen assembly comprises:

a plastic frame ultrasonically welded to said canister body over said plenum therein for rigid attachment and hermetic sealing of said plastic frame to said canister body, a window in said plastic frame between said plenum and said mass of carbon granules in said canister body, and a flat screen in said window in said plastic frame having a peripheral edge insert molded in said plastic frame completely around said window for rigid attachment and hermetic sealing of said peripheral edge of said flat screen to said plastic frame.

2. The fuel vapor storage canister recited in claim 1 wherein said plastic frame comprises:

a flat plastic rectangle, an integral continuous boss on a side of said flat plastic rectangle having a sharp edge engaging said canister body and concentrating the energy of the ultrasonic weld to effect fusion of said plastic rectangle and said canister body at said integral continuous boss, and a continuous lip on said flat plastic rectangle between said integral continuous boss and said window of said plastic frame defining a flash dam for preventing contamination of said screen in said window during ultrasonic welding of said plastic frame to said canister body.

3. The fuel vapor storage canister recited in claim 2 wherein said flat screen comprises:

a spun polyester fiber screen.

* * * * *